US007431501B2

(12) United States Patent
Main

(10) Patent No.: US 7,431,501 B2
(45) Date of Patent: Oct. 7, 2008

(54) BAG ASSEMBLY PROVIDING ELECTROSTATIC DISCHARGE PROTECTION

(75) Inventor: Richard E. Main, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 731 days.

(21) Appl. No.: 10/989,863

(22) Filed: Nov. 15, 2004

(65) Prior Publication Data

US 2006/0104549 A1 May 18, 2006

(51) Int. Cl.

| | |
|---|---|
| ***B65D 30/00*** | (2006.01) |
| ***B65D 33/06*** | (2006.01) |
| ***B65D 33/00*** | (2006.01) |
| ***B65D 30/08*** | (2006.01) |
| ***B65D 33/02*** | (2006.01) |
| ***B65D 85/00*** | (2006.01) |

(52) U.S. Cl. ..... 383/107; 383/109; 383/105; 383/119; 383/6; 206/720

(58) Field of Classification Search ..... 206/719, 206/720; 383/6, 12, 119, 117, 109, 38, 107, 383/108, 111; 190/125

See application file for complete search history.

(56) References Cited

U.S. PATENT DOCUMENTS

| | | | | |
|---|---|---|---|---|
| 3,647,134 | A * | 3/1972 | Carnevalino | 206/455 |
| 4,154,344 | A | 5/1979 | Yenni, Jr. et al. | 206/524.6 |
| 4,471,872 | A * | 9/1984 | Dedow | 206/720 |
| 4,648,121 | A * | 3/1987 | Lowe | 383/76 |
| 4,773,534 | A | 9/1988 | DeHeras et al. | 206/328 |
| 4,906,494 | A | 3/1990 | Babinec et al. | 428/35.2 |
| 4,907,633 | A * | 3/1990 | Eckstein | 150/105 |
| 4,915,222 | A * | 4/1990 | Reidinger et al. | 206/709 |
| 4,987,997 | A * | 1/1991 | Raszewski et al. | 206/720 |
| 5,097,949 | A * | 3/1992 | Heldwein | 206/720 |
| 5,526,924 | A * | 6/1996 | Klutznick | 206/5 |
| 5,533,809 | A * | 7/1996 | Gorman | 383/11 |
| 5,791,485 | A * | 8/1998 | Carbonneau | 206/720 |
| 5,881,883 | A * | 3/1999 | Siegelman | 206/720 |
| 5,947,298 | A | 9/1999 | Huang | 206/769 |
| 6,112,772 | A * | 9/2000 | Ebadat et al. | 139/1 R |
| 6,129,210 | A * | 10/2000 | Rustemeyer et al. | 206/736 |
| 6,238,091 | B1 * | 5/2001 | Mogil | 383/110 |
| 6,371,642 | B1 * | 4/2002 | Nelson et al. | 383/23 |
| 6,572,942 | B2 * | 6/2003 | Wurr et al. | 428/36.1 |
| 6,763,946 | B1 * | 7/2004 | Martin | 206/701 |
| 2002/0012480 | A1 * | 1/2002 | Konno | 383/111 |
| 2002/0036149 | A1 * | 3/2002 | Kwong | 206/308.3 |
| 2003/0054125 | A1 * | 3/2003 | Singer et al. | 428/35.5 |

* cited by examiner

*Primary Examiner*—Jes F Pascua
(74) *Attorney, Agent, or Firm*—Gerhard W. Thielman, Esq.

(57) ABSTRACT

An electrostatic discharge (ESD) protective bag assembly includes a tote bag and an envelope made from ESD protective material positioned at least partially within the tote bag. The envelope may be defined by two sheets of ESD protective material joined along at least two opposing sides thereof to form join regions. At least one layer of a reinforcing material, such as a fibrous web, is coupled to a portion of each of the join regions. The tote bag and envelope may be coupled to one another by stitches that pass through the reinforcing material.

27 Claims, 4 Drawing Sheets

BAG ASSEMBLY PROVIDING ELECTROSTATIC DISCHARGE PROTECTION

STATEMENT OF GOVERNMENT INTEREST

The invention described herein was made in the performance of official duties by employees of the Department of the Navy and may be manufactured, used, licensed by or for the Government for governmental purposes without payment of any royalties thereon.

FIELD OF THE INVENTION

The following description relates generally to the transportation of devices sensitive to electrostatic discharge (ESD), and more particularly to a transportable bag assembly that provides ESD protection for the contents thereof.

BACKGROUND

Electrostatic discharge (ESD) can inadvertently initiate the detonation train in certain ordnance, as well as damage a wide variety of electronic devices. Vulnerability to ESD increases dramatically when ordnance or electronic devices are being transported because they are typically removed from a safe or grounded environment such as housing or a complete grounded system in which they are a component. Accordingly, a variety of ESD bags or envelopes have been designed to provide for ordnance and/or electronic device transportation. In general, ESD bags are made from material that is easily torn. Thus, ESD bags are generally good for only a "one time" usage, or must be packed in a specially-designed protective container if rough handling is expected. However, there is no simple, reusable and transportable system for transporting ESD-sensitive ordnance or electronic devices in an ESD protected manner.

SUMMARY

An assembly is described that can be used to transport ESD-sensitive ordnance or electronic devices while protecting them from ESD. The assembly may be a reusable bag assembly that affords ESD protection for the contents thereof.

In one general aspect, a bag assembly provides electrostatic discharge (ESD) protection for the contents thereof. A tote bag has a first end that can be opened and closed, and a closed second end that opposes the first end. An envelope made from ESD protective material is positioned partially in the tote bag. More specifically, the envelope has an open end, and is folded at an end thereof that opposes the open end with the end so-folded positioned to abut the closed second end of the tote bag. Further, the envelope is defined by two sheets of ESD protective material joined along at least two opposing sides thereof to form join regions. At least one layer of a reinforcing material, such as, for example, a fibrous web, is coupled to a portion of each of the join regions that resides within the tote bag. The tote bag and envelope are coupled to one another by stitches that pass through the reinforcing material.

Other features will become apparent from the following description, including the drawings, and from the claims.

DETAILED DESCRIPTION

Figure 1:
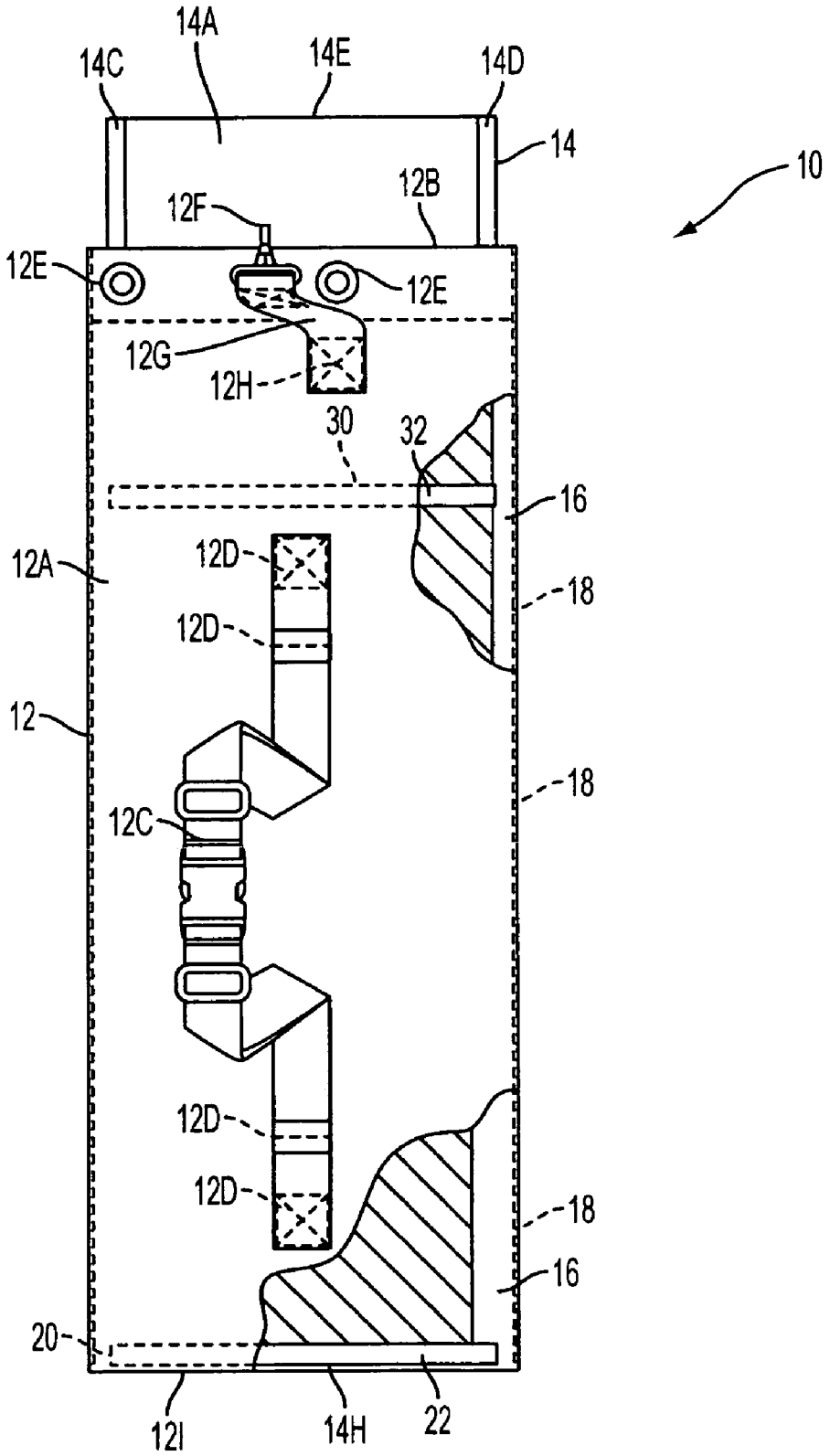
FIG. 1 is a partially cut-away side view of one implementation of a bag assembly providing ESD protection.

Referring now to FIG. 1, one implementation of a bag assembly providing ESD protection for the contents thereof is illustrated and referenced generally by numeral 10. Bag assembly 10 can be sized and shaped as needed to satisfy size constraints of contents (not shown) to be stored therein.

Bag assembly 10 includes an outer tote bag 12 defined by a flexible bag 12A having one open end 12B formed thereby. Bag 12A can be made from a wide variety of rugged materials designed to withstand environmental conditions to which bag 12A will be subjected. Accordingly, the choice of material for bag 12A is not a limitation.

To facilitate the carrying of tote bag 12, a carrying strap 12C optionally may be coupled to bag 12A. For example, carrying strap 12C can be adjustable in length and can be stitched to bag 12A at one or more stitch locations 12D. Additional straps, different strap configurations (e.g., shoulder straps), and/or strap attachment methodologies can be used.

Bag 12A may be further equipped to provide for the opening/closing of open end 12B. For example, as shown, a "duffle bag" closing scheme is used where eyelets 12E are provided about the periphery of open end 12B. In order to close bag 12A, eyelets 12E are aligned and a clip 12F is coupled thereto. Clip 12F can be attached to bag 12A by, for example, a strap 12G stitched to bag 12A at 12H. Other types of closure systems may be used at open end 12B. For example, a drawstring closure system, a zipper closure system, a hook and loop closure system, or a button closure system, among others, may be used.

Tote bag 12 serves as the outer bag to at least partially contain an electrostatic discharge (ESD) liner 14 in which electronically-sensitive contents (not shown) will be stored for transportation.

Figure 2:
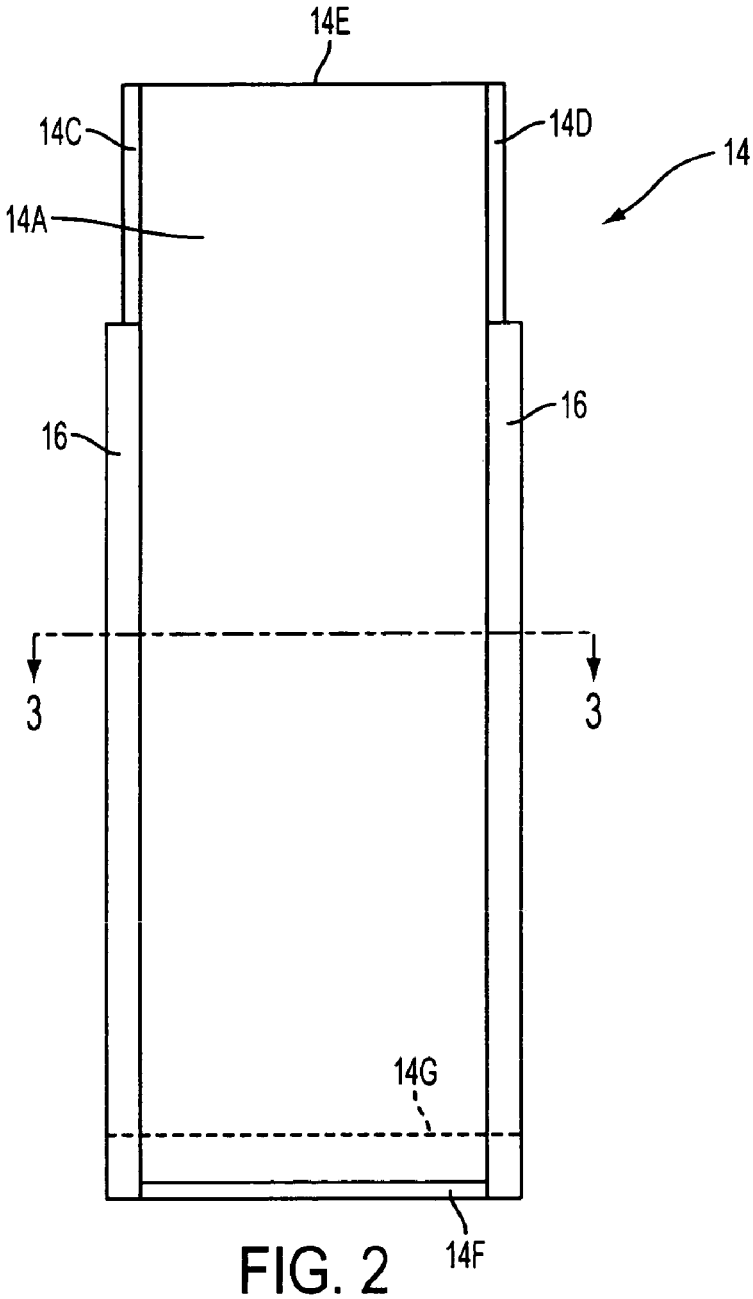
FIG. 2 is a plan view of one implementation of an ESD liner sub-assembly used in the bag assembly of FIG. 1.
Figure 3:
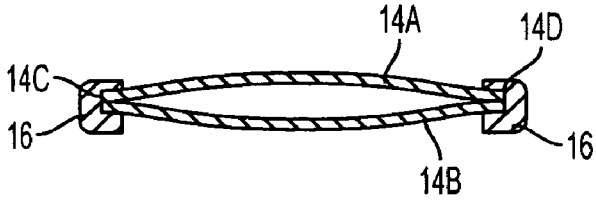
FIG. 3 is a cross-sectional view of the ESD liner taken along lines 3-3 of FIG. 2.

Referring to FIGS. 2 and 3, one implementation of ESD liner 14 is shown in isolation. In this implementation, the ESD liner 14 is formed as an envelope made from two sheets 14A and 14B of ESD material (e.g., a flexible and electrostatic protective material satisfying the performance standards established by MIL-PRF-81705). For example, sheets 14A and 14B can be joined together (e.g., heat sealed) along three sides thereof. Specifically, opposing edges are sealed at regions 14C and 14D, and one end of ESD liner 14 is sealed at end 14F thereby leaving the envelope open at end 14E. In another implementation, the envelope may be constructed from a single sheet of ESD material. In yet another implementation, the envelope may be constructed from several sheets of ESD material.

In general, ESD liner 14 is sewn into bag 12. However, because ESD material tears easily, such sewing can initiate small tears that can compromise the ESD performance of ESD liner 14. In one implementation, this problem is overcome by coupling one or more layers of a reinforcing material, such as, for example, a fibrous web, to portions of join regions 14C and 14D that will be used to stitch liner 14 to bag 12A. For example, in one implementation, the reinforcing material is a tape 16 incorporating a web of fibers (e.g., bi-directional packing tape or high-temperature tape). The tape 16 may be adhered to each of sheets 14A and 14B along portions of each of join regions 14C and 14D, and may be wrapped around the edges of join regions 14C and 14D.

Next, in one implementation, sealed end 14F may be folded onto itself at least one time (e.g., along dashed line 14G) to thereby form a folded end 14H (FIG. 1) that is positioned to abut the closed end 121 of bag 12A. ESD liner 14 is then coupled to bag 12A by stitching (represented by dashed lines 18) that passes through bag 12A, tape 16, and portions of joined regions 14C and 14D to which tape 16 is adhered. The reinforcing material, such as the fibrous tape 16, retains stitches 18 so that stitch holes (not shown) formed in joined regions 14C and 14D cannot grow into tears that could compromise the ESD protection performance of ESD liner 14. In another implementation, sealed end 14F is not folded onto itself.

ESD liner 14 may sized such that, after assembly to bag 12A as just described, open end 14E of ESD liner 14 extends out from open end 12B of bag 12A, as shown in FIG. 1. In this way, when contents are placed in ESD liner 14 (through open end 14E), ESD liner 14 can be rolled or folded onto itself starting at open end 14E until ESD liner 14 fits into bag 12A. Bag 12A can then be closed to retain the folded form of open end 14E. As a result, the combination of (i) join regions 14C/14D, and (ii) fold(s) formed at open ends 14E and 14F, a Faraday cage is formed about the contents of ESD liner 14.

In addition to the use of stitching 18 to retain ESD liner 14 in bag 12A, folded end 14H (i.e., formed by folding at 14G) can be positively retained in its abutting relationship with bag 12A. This has the benefit of assuring that the weight of contents resting against folded end 14H is transferred to bag 12A as opposed to being supported by the weaker sealed end 14F of ESD liner 14. Such positive retaining of folded end 14H can be achieved by using hook-and-loop fastening strips with one strip 20 coupled (e.g., stitched) to the inside of bag 12A and the complementary strip 22 coupled to ESD liner 14 along folded end 14H. To avoid unnecessary puncturing of ESD liner 14, strip 22 can be adhered thereto using, for example, a flexible double-sided tape.

To assure that the opening of bag 12A simultaneously causes the opening of ESD liner 14 (at open end 14E), additional hook-and-loop fastening strips can be coupled to bag 12A and ESD liner 14. More specifically, one (or more) strip 30 can be coupled (e.g., stitched) to the inside of bag 12A near open end 12B and the complementary strip(s) 32 could be coupled to ESD liner 14 at a corresponding position(s). Strip 32 can be adhered to ESD liner 14 using a flexible double-sided tape.

As described, the tote bag assembly is easily opened/closed and provides ESD protection of the contents stored therein. The assembly minimizes the risk of ESD liner tears while providing a reusable and easily-carried tote bag for field transportation of ESD-sensitive ordnance or electronic devices.

Other implementations are within the scope of the following claims. For example, sealed end 14F of ESD liner 14 could be realized by a fold if ESD liner 14 were made from a single piece of ESD material that was folded at the location of end 14F. If folded in this fashion, the folded region of ESD liner 14 should be placed in an abutting relationship with the closed end 121 of bag 12A. Furthermore, the placement of tape 16 is not limited to that shown in FIG. 3—as other non-limiting options are illustrated in FIGS. 4A-4D.

Figure 4A:
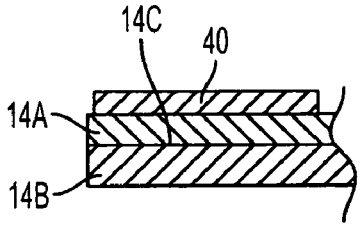
FIG. 4A is a cross-sectional view of the ESD liner's join region in an implementation having a single strip of tape that incorporates a fibrous web.
Figure 4B:
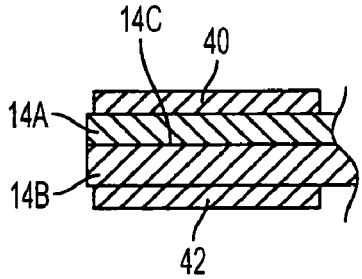
FIG. 4B is a cross-sectional view of the ESD liner's join region in an implementation having two strips of tape that incorporate a fibrous web.
Figure 4C:
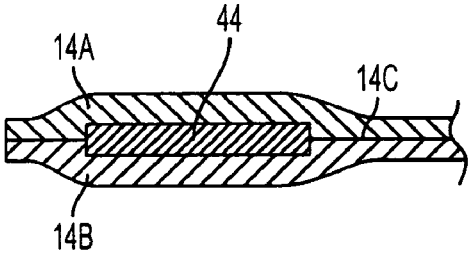
FIG. 4C is a cross-sectional view of the ESD liner's join region in an implementation having a fibrous web incorporated between the ESD material layers.

In FIG. 4A, for example, a single strip of tape 40 incorporating a fibrous web is applied just to sheet 14A at join region 14C. FIG. 4B illustrates the use of two individual strips of tape 40 and 42 applied to sheets 14A and 14B, respectively, at join region 14C. FIG. 4C illustrates the use of a strip 44 of a reinforcing material that is a fibrous web material (but not necessarily a tape) that is captured between sheets 14A and 14B at join region 14C during the sealing process.

Figure 4D:
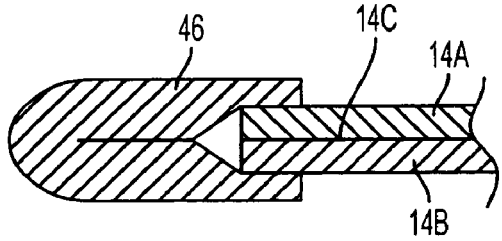
FIG. 4D is a cross-sectional view of the ESD liner's join region in an implementation having a single strip of tape that incorporates a fibrous web, where the tape is folded onto itself beyond the edge of the join region to create a stitch region.

Yet another option is shown in FIG. 4D where a single strip of reinforcing material, in this case a tape 46 incorporating a fibrous web, is adhered to the outer edges of each of sheets 14A and 14B at join region 14C, and folded onto itself to create a fibrous stitch region. Thus, regardless of how a reinforcing material, such as, for example, a fibrous web, is incorporated in the join region, the fibrous web will define the stitching region for attachment of ESD liner to the outer tote bag.

Figure 5:
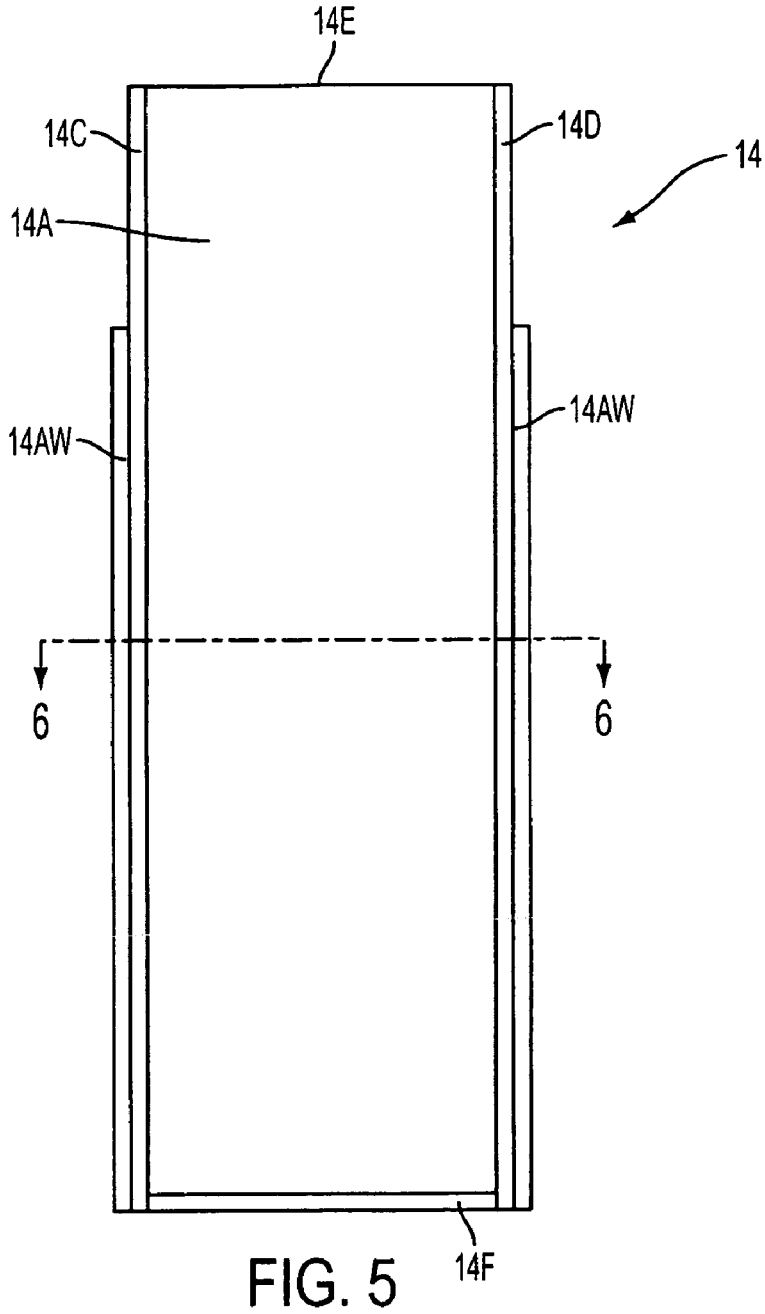
FIG. 5 is a plan view of another implementation of an ESD liner sub-assembly used in the bag assembly of FIG. 1.
Figure 6:
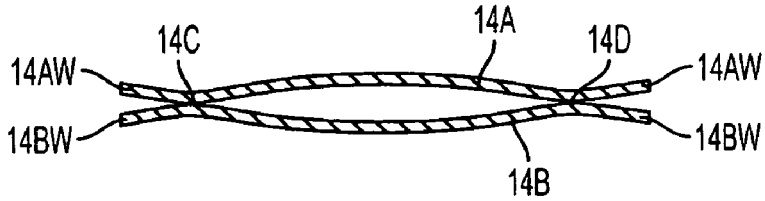
FIG. 6 is a cross-sectional view of the ESD liner taken along lines 6-6 of FIG. 5.

In certain implementations, it may be possible to eliminate the use of a reinforcing material such as a fibrous web or tape. For example, as illustrated in FIGS. 5 and 6, ESD liner 14 has sheets 14A and 14B joined/sealed at join regions 14C/14D such that wings 14AW and 14BW are formed outside of join regions 14C and 14D. The completed bag assembly is formed by stitching ESD liner 14 to tote bag 12 using wings 14AW/14BW as the "stitch-through" regions. Use of hook-and-loop fastening strips (e.g., strips 20/22 and 30/32) would be used as described above to respectively seat/retain the ESD liner in the tote bag, and assure that the ESD liner opens in correspondence with the opening of the tote bag.

What is claimed is:

1. A bag assembly providing electrostatic discharge (ESD) protection for the contents thereof, comprising:

a tote bag having a first end configured to be opened and closed, and a closed second end opposing the first end;

an envelope made from an ESD protective material positioned at least partially within the tote bag, the envelope forming join regions along at least two opposing sides thereof; and at least one layer of a reinforcing material coupled to a portion of each of the join regions that resides within the tote bag, wherein the tote bag and the envelope are coupled to one another by stitches that pass through the reinforcing material, the reinforcing material comprises a fibrous web, and the fibrous web comprises a tape.

2. The bag assembly of claim 1 wherein the envelope is defined by two sheets of ESD protective material joined along at least two opposing sides thereof.

3. The bag assembly of claim 2 wherein the envelope includes an open end and is folded at an end thereof opposing the open end, wherein the end so-folded is positioned to abut the closed second end of the tote bag.

4. The bag assembly of claim 1 wherein the reinforcing material comprises at least one layer of tape having bi-directional fibers incorporated therein.

5. The bag assembly of claim 1 wherein the end so-folded of the envelope is coupled to the closed second end of the tote bag.

6. The bag assembly of claim 5 wherein the end so-folded of the envelope is coupled to the closed second end of the tote bag using a hook-and-loop fastening mechanism.

7. The bag assembly of claim 1 further comprising a coupling mechanism attached to the envelope and the tote bag, wherein the open end of the envelope opens to form a two-dimensional opening adapted to receive contents therethrough that are to be stored in the envelope when the first end of the tote bag is opened.

8. The bag assembly of claim 7 wherein the coupling mechanism further comprises a hook-and-loop fastening mechanism and wherein a first portion of the hook-and-loop fastening mechanism is coupled to the envelope and a second portion of the hook-and-loop fastening mechanism is coupled to the tote bag.

9. The bag assembly of claim 8 further comprising double-sided tape configured to attach the first portion of the hook-and-loop fastening mechanism to the envelope.

10. The bag assembly of claim 1 further comprising a closure mechanism coupled to the first end of the tote bag.

11. The bag assembly of claim 1 further comprising at least one carrying strap coupled to the tote bag.

12. A bag assembly providing electrostatic discharge (ESD) protection for the contents thereof, comprising:

a tote bag having a first end configured to be opened and closed, and a closed second end opposing the first end;

an envelope made from an ESD protective material positioned at least partially within the tote bag, the envelope having an open end, and being folded at an end thereof opposing the open end with the end so-folded positioned to abut the closed second end of the tote bag, the envelope defined by two sheets of ESD protective material sealed together along at least two opposing sides thereof to form sealed regions;

at least one strip of tape adhered at least partially to each of the sealed regions, the tape incorporating a fibrous web; and the tote bag and the envelope being coupled to one another by stitches that pass through the tape and portions of the sealed regions to which the tape is adhered.

13. The bag assembly of claim 12 further comprising means for coupling the end so-folded of the envelope to the closed second end of the tote bag.

14. The bag assembly of claim 13 wherein the means for coupling comprises hook-and-loop fastening means.

15. The bag assembly of claim 12 further comprising means positioned between the envelope and the tote bag for causing the open end of the envelope to open to form a two-dimensional opening adapted to receive contents therethrough that are to be stored in the envelope when the first end of the tote bag is opened.

16. The bag assembly of claim 15 wherein the means positioned between the envelope and the tote bag comprises hook-and-loop fastening means wherein a portion of the hook-and-loop fastening means is coupled to the envelope and a complementary portion of the hook-and-loop fastening means is coupled to the tote bag.

17. The bag assembly of claim 16 further comprising double-sided tape for attaching the portion of the hook-and-loop fastening means to the envelope.

18. The bag assembly of claim 12 further comprising closure means coupled to the first end of the tote bag.

19. The bag assembly of claim 12 further comprising at least one carrying strap coupled to the tote bag.

20. A bag assembly providing electrostatic discharge (ESD) protection for the contents thereof, comprising:

a tote bag having a first end configured to be opened and closed, and a closed second end opposing the first end;

an envelope made from an ESD protective material positioned at least partially within the tote bag and extendable therefrom, the envelope having an open end, being folded at an end thereof opposing the open end with the end so-folded positioned to abut the closed second end of the tote bag, and being dimensioned such that the open end is extendable from the first end of the tote bag when the end so-folded is positioned to abut the closed second end of the tote bag, the envelope defined by two sheets of ESD protective material sealed together along at least two opposing sides thereof to form sealed regions;

at least one strip of tape adhered at least partially to each of the sealed regions residing within the tote bag, the tape incorporating a fibrous web; and the tote bag and the envelope being coupled to one another by stitches that pass through the tape and portions of the sealed regions to which the tape is adhered.

21. The bag assembly of claim 20 wherein the end so-folded of the envelope is coupled to the closed second end of the tote bag.

22. The bag assembly of claim 21 wherein the end so-folded of the envelope is coupled to the closed second end of the tote bag using a hook-and-loop fastening mechanism.

23. The bag assembly of claim 20 further comprising a coupling mechanism attached to the envelope and the tote bag, wherein the open end of the envelope opens to form a two-dimensional opening adapted to receive contents therethrough that are to be stored in the envelope when the first end of the tote bag is opened.

24. The bag assembly of claim 23 wherein the coupling mechanism further comprises a hook-and-loop fastening mechanism and wherein a first portion of the hook-and-loop fastening mechanism is coupled to the envelope and a second portion of the hook-and-loop fastening mechanism is coupled to the tote bag.

25. The bag assembly of claim 24 further comprising double-sided tape configured to attach the first portion of the hook-and-loop fastening means to the envelope.

26. The bag assembly of claim 20 further comprising a closure mechanism coupled to the first end of the tote bag.

27. The bag assembly of claim 20 further comprising at least one carrying strap coupled to the tote bag.

* * * * *